US009765550B2

(12) United States Patent
Hemmingsen et al.

(10) Patent No.: US 9,765,550 B2
(45) Date of Patent: Sep. 19, 2017

(54) PASSIVE DOOR LOCK MECHANISMS

(71) Applicant: Amesbury Group, Inc., Amesbury, MA (US)

(72) Inventors: Austin Hemmingsen, Sioux Falls, SD (US); Allen Rickenbaugh, Sioux Falls, SD (US); Tracy Lammers, Sioux Falls, SD (US); Gary E. Tagtow, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 387 days.

(21) Appl. No.: 14/012,569

(22) Filed: Aug. 28, 2013

(65) Prior Publication Data

US 2014/0060127 A1 Mar. 6, 2014

Related U.S. Application Data

(60) Provisional application No. 61/695,868, filed on Aug. 31, 2012.

(51) Int. Cl.
*E05B 63/12* (2006.01)
*E05B 15/02* (2006.01)
(Continued)

(52) U.S. Cl.
CPC ..... *E05B 63/12* (2013.01); *E05B 15/021* (2013.01); *E05B 17/2053* (2013.01);
(Continued)

(58) Field of Classification Search
CPC ..... E05B 15/00; E05B 15/02; E05B 15/0205; E05B 15/021; E05B 15/024; E05B 55/00;
(Continued)

(56) References Cited

U.S. PATENT DOCUMENTS 419,384 A 1/1890 Towne
651,947 A 6/1900 Johnson
(Continued)

FOREIGN PATENT DOCUMENTS

AT 844928 12/1920
DE 1002656 2/1957
(Continued)

OTHER PUBLICATIONS

PCT Invitation to Pay Fees in Application PCT/US2013/057102, mailed Feb. 3, 2014, 5 pgs.
(Continued)

*Primary Examiner* — Christopher Boswell

(57) ABSTRACT

A lock mechanism for an inactive door includes a housing configured to receive a locking element from an active door lock. A slide is movably received in the housing and includes a drive bar connection element, wherein when the slide is in an unlocked position, the drive bar connection element is located in a path of travel of the deadbolt, and wherein when the slide is in a locked position, the drive bar connection element is located outside the path of travel of the deadbolt. At least one drive bar at least partially received in the housing and is connected to the drive bar connection element. The drive bar is actuated by an actuator located remote from the housing. A blocking element located within the housing, wherein the blocking element prevents movement of the slide from the locked position to the unlocked position.

14 Claims, 10 Drawing Sheets

(51) Int. Cl.

| | |
|---|---|
| ***E05B 17/20*** | (2006.01) |
| ***E05C 7/04*** | (2006.01) |
| ***E05B 65/00*** | (2006.01) |
| *E05B 59/00* | (2006.01) |
| *E05C 9/04* | (2006.01) |
| *E05B 17/00* | (2006.01) |

(52) U.S. Cl.
CPC ..... *E05B 65/00* (2013.01); *E05C 7/04* (2013.01); *E05B 59/00* (2013.01); *E05B 2017/0095* (2013.01); *E05C 9/04* (2013.01); *Y10T 70/5279* (2015.04); *Y10T 292/0968* (2015.04)

(58) Field of Classification Search
CPC .... E05B 63/0017; E05B 63/12; E05B 63/126; E05B 2015/0053; E05B 2015/0066; E05B 2015/02
USPC ..... 70/101, 102, 130, 104, 124, 129, 131
See application file for complete search history.

(56) References Cited

U.S. PATENT DOCUMENTS 738,280 A 9/1903 Bell et al.
972,769 A 10/1910 Lark
1,094,143 A * 4/1914 Hagstrom ..... E05B 65/0075 70/118
1,142,463 A 6/1915 Sheperd
1,251,467 A 1/1918 Blixt et al.
1,277,174 A 8/1918 Bakst
1,359,347 A 11/1920 Fleisher
1,366,909 A 2/1921 Frommer
1,596,992 A 8/1926 Ognowicz
1,646,674 A 10/1927 Angelillo
1,666,654 A 4/1928 Hiering
1,716,113 A 6/1929 Carlson
2,535,947 A 12/1950 Newell
2,739,002 A 3/1956 Johnson
2,862,750 A 12/1958 Minke
3,064,462 A 11/1962 Ng et al.
3,162,472 A 12/1964 Rust
3,250,100 A 5/1966 Cornaro
3,332,182 A 7/1967 Mark
3,413,025 A 11/1968 Sperry
3,437,364 A 4/1969 Walters
RE26,677 E 10/1969 Russell et al.
3,586,360 A 6/1971 Perrotta
3,806,171 A 4/1974 Fernandez
3,899,201 A 8/1975 Paioletti
3,904,229 A 9/1975 Waldo
3,953,061 A 4/1976 Hansen et al.
4,076,289 A 2/1978 Fellows et al.
4,116,479 A 9/1978 Poe
4,132,438 A 1/1979 Guymer
4,236,396 A 12/1980 Surko et al.
4,288,944 A 9/1981 Donovan
4,476,700 A 10/1984 King
4,500,122 A 2/1985 Douglas
4,593,542 A 6/1986 Rotondi et al.
4,602,812 A 7/1986 Bourne
4,607,510 A 8/1986 Shanaan et al.
4,643,005 A 2/1987 Logas
4,691,543 A 9/1987 Watts
4,754,624 A 7/1988 Fleming et al.
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,118,151 A 6/1992 Nicholas, Jr. et al.
5,125,703 A 6/1992 Clancy et al.
5,171,050 A 12/1992 Mascotte
5,172,944 A 12/1992 Munich et al.
5,197,771 A 3/1993 Kaup et al.
5,265,452 A 11/1993 Dawson et al.
5,290,077 A 3/1994 Fleming
5,373,716 A 12/1994 MacNeil et al.
5,382,060 A 1/1995 O'Toole et al.
5,388,875 A 2/1995 Fleming
5,404,737 A 4/1995 Hotzl
5,482,334 A 1/1996 Hotzl
5,495,731 A 3/1996 Riznik
5,513,505 A 5/1996 Danes
5,516,160 A 5/1996 Kajuch
5,524,941 A 6/1996 Fleming
5,524,942 A 6/1996 Fleming
5,609,372 A 3/1997 Ponelle
5,620,216 A 4/1997 Fuller
5,707,090 A 1/1998 Sedley
5,716,154 A 2/1998 Miller et al.
5,722,704 A 3/1998 Chaput et al.
5,782,114 A 7/1998 Zeus et al.
5,791,700 A 8/1998 Biro
5,820,170 A 10/1998 Clancy
5,820,173 A 10/1998 Fuller
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,915,764 A 6/1999 MacDonald
5,951,068 A 9/1999 Strong et al.
6,050,115 A 4/2000 Schroter et al.
6,094,869 A 8/2000 Magoon et al.
D433,916 S 11/2000 Frey
6,148,650 A * 11/2000 Kibble ..... E05B 17/2088 70/106
6,174,004 B1 * 1/2001 Picard ..... E05B 65/1046 292/165
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,327,881 B1 12/2001 Grundler et al.
6,389,855 B2 5/2002 Renz et al.
6,443,506 B1 9/2002 Su
6,454,322 B1 9/2002 Su
6,502,435 B2 1/2003 Watts et al.
6,516,641 B1 2/2003 Segawa
6,637,784 B1 10/2003 Hauber et al.
6,672,632 B1 1/2004 Speed et al.
6,688,656 B1 2/2004 Becken
6,733,051 B1 5/2004 Cowper
6,776,441 B2 8/2004 Liu
6,810,699 B2 11/2004 Nagy
6,871,451 B2 3/2005 Harger et al.
6,935,662 B1 8/2005 Hauber et al.
6,971,686 B2 12/2005 Becken
6,994,383 B2 2/2006 Morris
7,025,394 B1 4/2006 Hunt
7,083,206 B1 8/2006 Johnson
7,155,946 B2 1/2007 Lee et al.
7,207,199 B2 4/2007 Smith et al.
7,249,791 B2 7/2007 Johnson
7,261,330 B1 8/2007 Hauber
7,404,306 B2 7/2008 Walls et al.
7,418,845 B2 9/2008 Timothy
7,513,540 B2 * 4/2009 Hagemeyer ..... E05B 15/0205 292/156
7,634,928 B2 12/2009 Hunt
7,677,067 B2 3/2010 Riznik et al.
7,707,862 B2 5/2010 Walls et al.

(56) References Cited

U.S. PATENT DOCUMENTS

| | | | | |
|---|---|---|---|---|
| 7,726,705 | B2 | 6/2010 | Kim | |
| 7,735,882 | B2 | 6/2010 | Abdollahzadeh et al. | |
| 7,856,856 | B2 | 12/2010 | Shvartz | |
| 7,878,034 | B2 | 2/2011 | Alber et al. | |
| 8,182,002 | B2 | 5/2012 | Fleming | |
| 8,348,308 | B2 | 1/2013 | Hagemeyer et al. | |
| 8,376,414 | B2 | 2/2013 | Nakanishi et al. | |
| 8,382,166 | B2 | 2/2013 | Hagemeyer et al. | |
| 8,398,126 | B2 | 3/2013 | Nakanishi et al. | |
| 8,840,153 | B2 * | 9/2014 | Juha | E05C 7/04 292/175 |
| 8,850,744 | B2 | 10/2014 | Bauman et al. | |
| 2002/0104339 | A1 | 8/2002 | Saner | |
| 2003/0159478 | A1 | 8/2003 | Nagy | |
| 2004/0107746 | A1 | 6/2004 | Chang | |
| 2004/0239121 | A1 | 12/2004 | Morris | |
| 2005/0103066 | A1 | 5/2005 | Botha et al. | |
| 2005/0144848 | A1 | 7/2005 | Harger et al. | |
| 2005/0229657 | A1 | 10/2005 | Johansson et al. | |
| 2007/0068205 | A1 | 3/2007 | Timothy | |
| 2007/0080541 | A1 | 4/2007 | Fleming | |
| 2007/0113603 | A1 | 5/2007 | Polster | |
| 2007/0170725 | A1 | 7/2007 | Speyer et al. | |
| 2008/0087052 | A1 | 4/2008 | Abdollahzadeh et al. | |
| 2008/0092606 | A1 | 4/2008 | Meekma | |
| 2008/0141740 | A1 | 6/2008 | Shvartz | |
| 2008/0150300 | A1 | 6/2008 | Harger et al. | |
| 2008/0156048 | A1 | 7/2008 | Topfer | |
| 2008/0156049 | A1 | 7/2008 | Topfer | |
| 2008/0178530 | A1 | 7/2008 | Ellerton et al. | |
| 2008/0179893 | A1 | 7/2008 | Johnson | |
| 2008/0184749 | A1 | 8/2008 | Alber et al. | |
| 2009/0078011 | A1 | 3/2009 | Avni | |
| 2010/0154490 | A1 | 6/2010 | Hagemeyer et al. | |
| 2010/0213724 | A1 | 8/2010 | Uyeda | |
| 2010/0236302 | A1 | 9/2010 | Uyeda | |
| 2010/0327610 | A1 | 12/2010 | Nakanishi et al. | |
| 2011/0198867 | A1 | 8/2011 | Hagemeyer et al. | |
| 2011/0289987 | A1 | 12/2011 | Chiou et al. | |
| 2012/0146346 | A1 | 6/2012 | Hagemeyer et al. | |
| 2012/0306220 | A1 | 12/2012 | Hagemeyer et al. | |
| 2013/0019643 | A1 | 1/2013 | Tagtow et al. | |
| 2013/0140833 | A1 | 6/2013 | Hagemeyer et al. | |
| 2013/0152647 | A1 | 6/2013 | Terei et al. | |
| 2013/0234449 | A1 | 9/2013 | Dery et al. | |
| 2014/0125068 | A1 | 5/2014 | Hagemeyer et al. | |
| 2014/0159387 | A1 | 6/2014 | Hagemeyer et al. | |
| 2016/0108650 | A1 | 4/2016 | Hagemeyer et al. | |
| 2016/0369525 | A1 | 12/2016 | Tagtow et al. | |

FOREIGN PATENT DOCUMENTS

| | | | |
|---|---|---|---|
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2581531 | A1 | 4/2013 |
| EP | 2584123 | A1 | 4/2013 |
| EP | 2584124 | A2 | 4/2013 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| GB | 226170 | | 4/1925 |
| GB | 264373 | A | 1/1927 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| SE | 309372 | | 3/1969 |
| WO | 96/25576 | | 8/1996 |
| WO | 02/33202 | | 4/2002 |
| WO | 2007/104499 | | 9/2007 |

OTHER PUBLICATIONS

PCT International Search Report and Written Opinion in International Application PCT/US2013/057102, mailed Apr. 23, 2014, 21 pgs.

"Intercity Locks—for All Your Security Needs—Fast", http://www.directlocks.co.uk/locks-multipoint-locks-c-123_96.html, accessed Oct. 27, 2011, original publication date unknown, 3 pgs.

"Intercity Locks—for All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—for All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

* cited by examiner

PASSIVE DOOR LOCK MECHANISMS

CROSS-REFERENCE TO RELATED APPLICATIONS

This application claims priority to and the benefit of U.S. Provisional Patent Application Ser. No. 61/695,868, filed Aug. 31, 2012, entitled "Passive Door Lock Mechanisms," the disclosure of which is hereby incorporated by reference herein in its entirety.

INTRODUCTION

Double doors, such as residential entry doors, have an active door (the door used for regular ingress and egress) and a passive door (the opposite door typically fixed in place, but that may be opened if desired). The passive door usually includes upper and lower shoot bolts that extend into the top and bottom of the door frame to form a secure connection. Common locking elements such as deadbolts and latches are located on the active door, and extend into the passive door to secure the double doors when locked. With the passive door secured at the top and bottom of the frame, and the active door secured to the passive door with a deadbolt, a force applied against the double doors will typically be insufficient to defeat the lock. Passive door locks, however, are often not intuitive and may result in user confusion. If a user believes they have locked the passive door when, in fact, they have not done so, the security of the door is compromised.

SUMMARY

In one aspect, the technology relates to a lock mechanism for an inactive door including: a housing configured to receive a locking element from an active door lock; a slide movably received in the housing and including a drive bar connection element, wherein when the slide is in an unlocked position, the drive bar connection element is located in a path of travel of the deadbolt, and wherein when the slide is in a locked position, the drive bar connection element is located outside the path of travel of the deadbolt; at least one drive bar at least partially received in the housing, wherein the drive bar is connected to the drive bar connection element and wherein the drive bar is actuated by an actuator located remote from the housing; and a blocking element located within the housing, wherein the blocking element prevents movement of the slide from the locked position to the unlocked position. In an embodiment, the blocking element is pivotably connected to the housing and includes a dog, wherein when the blocking element is in a slide blocked position, the dog is located within a path of travel of the slide. In another embodiment, the blocking element includes an actuator adapted to be actuated by at least one of a thumbturn located external to the housing and a key cylinder located external to the housing. In yet another embodiment, the blocking element is biased into both of the slide blocked position and a slide unblocked position. In still another embodiment, the blocking element is adapted to be rotated from the slide unblocked position to the slide blocked position only when the slide is in the locked position.

In an embodiment of the above aspect, the blocking element is pivotably connected to the slide and includes a projection, wherein when in a slide blocked position, the projection is positioned such that a pin extends into a path of vertical travel of the projection. In another embodiment, the blocking element is biased into a slide unblocked position, wherein the pin does not extend into a path of vertical travel of the projection. In yet another embodiment, the blocking element is adapted for movement from a slide unblocked position to the slide blocked position due to contact with the locking element extending into the housing. In still another embodiment, the blocking element includes an actuator pivotably connected to the housing.

In an embodiment of the above aspect, the slide is adapted to move vertically due to actuation of an element located discrete from housing. In another embodiment, the lock mechanism includes a drive bar actuation mechanism for moving the slide between the unlocked position and the locked position. In yet another embodiment, the drive bar actuation mechanism is located in a drive bar actuation mechanism housing discrete from the housing. In still another embodiment, the drive bar actuation mechanism is operated by pivotal movement of a handle located on the drive bar actuation mechanism housing.

In another aspect, the technology relates to a lock mechanism for an inactive door, the lock mechanism including: a housing configured to receive a deadbolt from an active door lock; and a selectively actuable blocking element, wherein when the blocking element is in an unlocked position, the blocking element is located in a path of travel of the deadbolt, and wherein when the blocking element is in a locked position, the blocking element is located outside the path of travel of the deadbolt. In an embodiment, the lock mechanism includes an actuator located within the housing, wherein the actuator is selectively actuable to prevent movement of the blocking element from the locked position to the unlocked position. In another embodiment, when the deadbolt is received in the housing, the blocking element is prevented from moving to the unlocked position.

In another aspect, the technology relates to a lock mechanism for an inactive door, the lock mechanism including: a slide for selectively moving a drive bar between a locked position and an unlocked position; a first blocking element for preventing movement of the slide from the locked position to the unlocked position, wherein the first blocking element prevents movement of the slide when contacted by a deadbolt inserted into the locking mechanism; and a second blocking element for selectively preventing movement of the slide from the locked position to the unlocked position. In an embodiment, the first blocking element is pivotably connected to the slide. In another embodiment, the first blocking element prevents movement of the slide due to contact with between the first blocking element and a projection extending from a housing of the lock mechanism. In another embodiment, the second blocking element prevents movement of the slide due to positioning a dog in a path of travel of the slide.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1B:
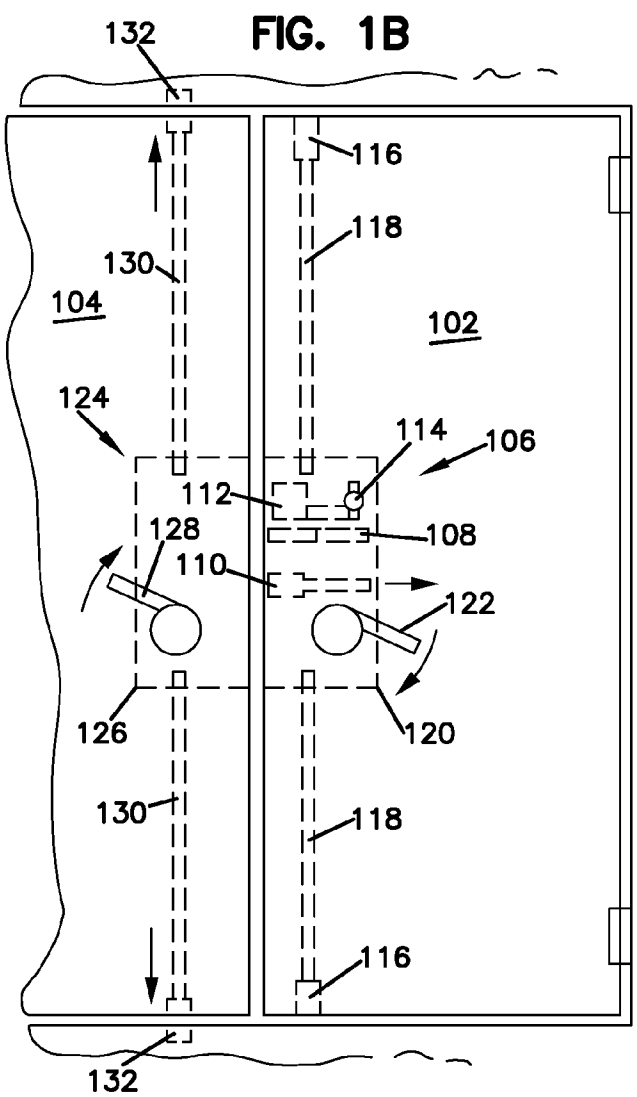
FIGS. 1A-1D are side views of a double door assembly having active and passive lock assemblies.
Figure 1A:
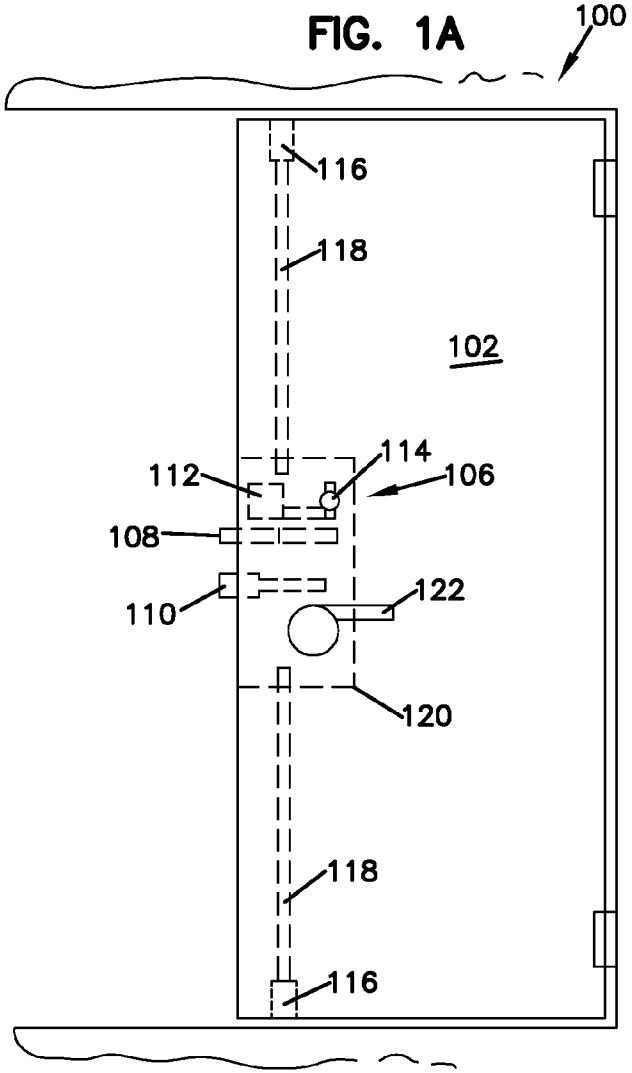
Figure 1D:
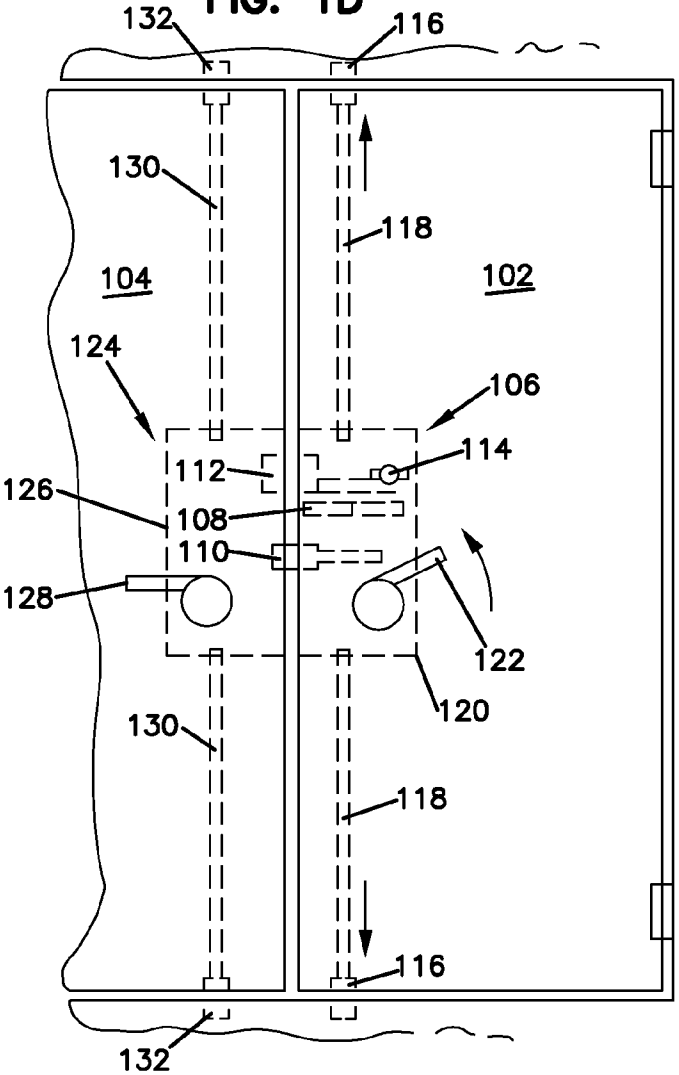
Figure 1C:
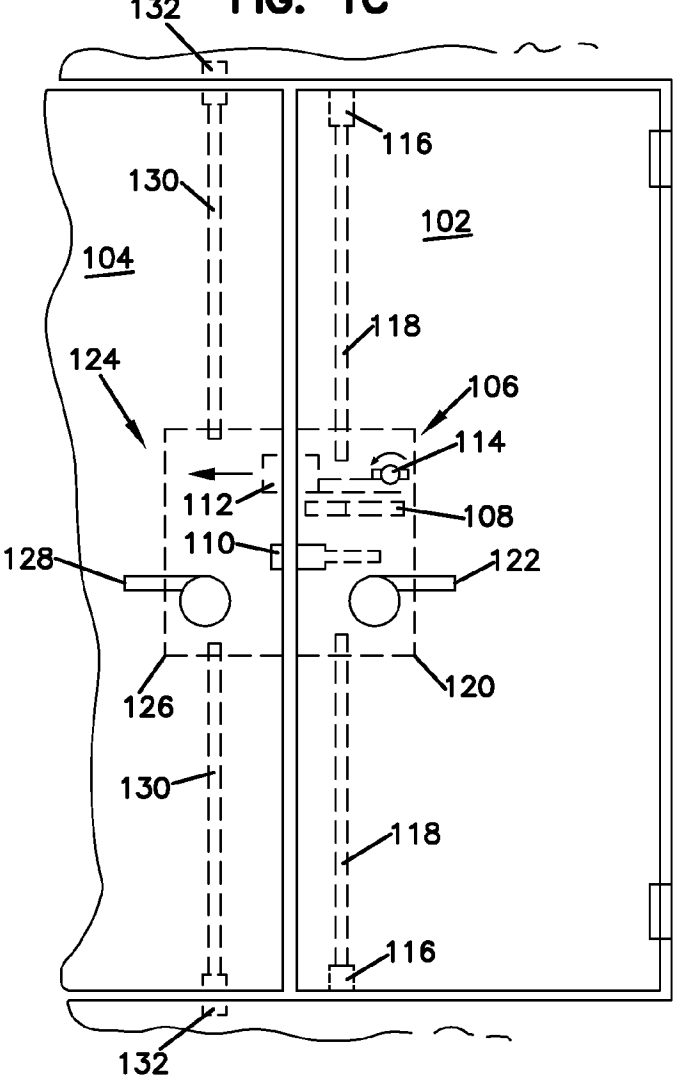

FIGS. 1A-1D depict a double door assembly 100 having an active door 102 and a passive door 104. The active door 102 includes an active door lock assembly 106 that may include any of a number of elements. In FIG. 1A, the active door lock assembly 106 includes an anti-slam device 108, a latch 110, and a deadbolt 112 actuated by a thumbturn 114 (as depicted in FIG. 1C). Certain types of active door lock assemblies may also include one or more shoot bolts 116 connected via drive bars 118 to a central lock housing 120. The shoot bolts 116 may be extended by rotating a handle 122 upwards (as depicted in FIG. 1D). The latch 110 (and shoot bolts 116 in locks that include such elements) may be retracted by rotating the handle 122 downwards, as depicted in FIG. 1B. The passive door 104 includes a passive door lock assembly 124 that includes a housing 126. Upward rotation of a handle 128 actuates drive bars 130, which in turn extend shoot bolts 132 (as depicted in FIG. 1B). The housing 126 may include openings in a front face to accommodate either or both of the latch 110 and the deadbolt 112 when those elements are extended (as depicted in FIGS. 1C and 1D).

Depicted in FIGS. 1A-1D are basic configurations of active and passive lock assemblies, but many modifications are contemplated and would otherwise be apparent to a person of skill in the art. For example, the active lock assembly 106 need not include an anti-slam device 108. The drive bars 118, 130 may move in opposite directions, as depicted, or in the same direction and accordingly actuate the shoot bolts 116, 132. The shoot bolts 116, 132 may be located as depicted or configured to penetrate a face of the opposing door. Alternatively or additionally, the handle 122 may actuate any of the locking elements of the active lock assembly 106 (that is, the deadbolt 112, shoot bolts 116, and/or latch 110). In other embodiments, the active door lock assembly 106 need not include the drive bars 118 and shoot bolts 116. Active and passive door lock assemblies are available, for example, from Amesbury Group, Inc., of Sioux Falls, S. Dak., as the P1000 lock. Additionally, although the active lock assembly 106 is depicted with a single housing 120, active door locks having multiple housings, such as the P3000, also available from Amesbury Group, may be utilized as the active door lock assembly. Other active door lock assemblies are described in U.S. patent application Ser. No. 13/189,305, filed Jul. 22, 2011, and entitled "Multi-Point Lock Having Sequentially-Activated Locking Elements," the disclosure of which is hereby incorporated by reference herein in its entirety. In general, however, the structure and operation of the active lock assembly is not necessarily critical to the function of the passive door lock assemblies described in more detail herein.

Figure 2:
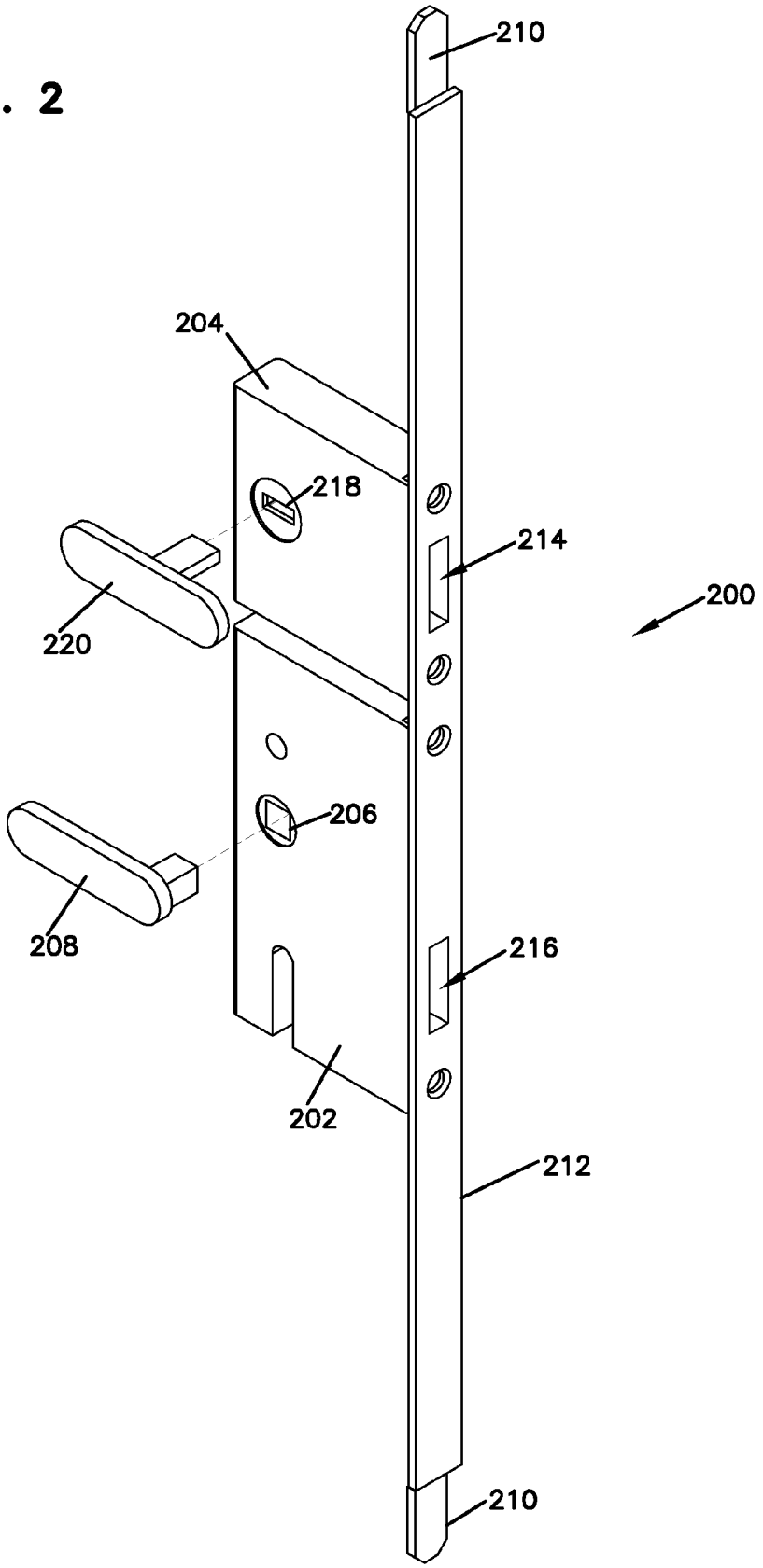
FIG. 2 is a perspective view of a passive lock assembly having a drive bar mechanism and a discrete passive lock mechanism.

FIG. 2 depicts a perspective view of a passive door lock assembly 200 that includes a drive bar mechanism housing 202 and a passive lock mechanism housing 204. The drive bar mechanism housing 202 includes, in the depicted embodiment, the components utilized to actuate one or more drive bars 210. Typically, an actuator 206 is used to actuate (either directly or indirectly) the drive bars 210. A handle 208 engages with the actuator 206 and may be rotated to extend or retract the drive bars 210 (as described with regard to FIGS. 1A-1D). The configuration of the drive bar mechanism located within the drive bar mechanism housing 202 is not critical to the operation of the passive door lock assembly described herein and is not described further. The drive bars 210 may operate as shoot bolts or may actuate remote shoot bolts. Each of the drive bar mechanism housing 202 and the passive lock mechanism housing 204 are secured to a face plate 212 that covers the drive bars 210. The faceplate 212 defines an opening 214 through which a locking element such as a deadbolt, from an active door lock assembly may be received. The faceplate 212 may also define an opening 216 through which a latch may be received. The passive lock mechanism housing 204 also includes an actuator 218 that may be actuated by a thumbturn 220 or key cylinder. Operation of the passive door lock mechanism located in the lock housing 204 is described in more detail below.

The passive lock assembly 200 depicted in FIG. 2 is designed to be understood by users that may not have familiarity with double door assemblies and associated passive door lock assemblies. The passive lock assembly is configured to utilize, in one embodiment, a thumbturn 218 and a handle 208 such that is similar in appearance to an active door lock assembly when installed. On active doors, as well as on single hinged doors, the operation of a handle (or door knob) to operate a latch, and the operation of a thumbturn to operate a deadbolt are well-known to virtually all users, who have been conditioned to understand that a door is not secured unless they actuate the thumbturn. One of the embodiments of the passive lock assembly described herein maintains the same or a similar visual appearance so as to make its correct operation thereof intuitive. A common misunderstanding for users unfamiliar with passive door locks is that the associated handle must be lifted to place the passive door in a locked condition. Accordingly, in one embodiment, the passive lock assembly described herein prevents a user from actuating the thumbturn unless the handle has been lifted and the passive door locked. Thus, a user will be compelled to take an action to lock the passive door before being able to turn the associated thumbturn, which a user intuitively understands as placing the door in a "locked" condition.

Figure 3A:
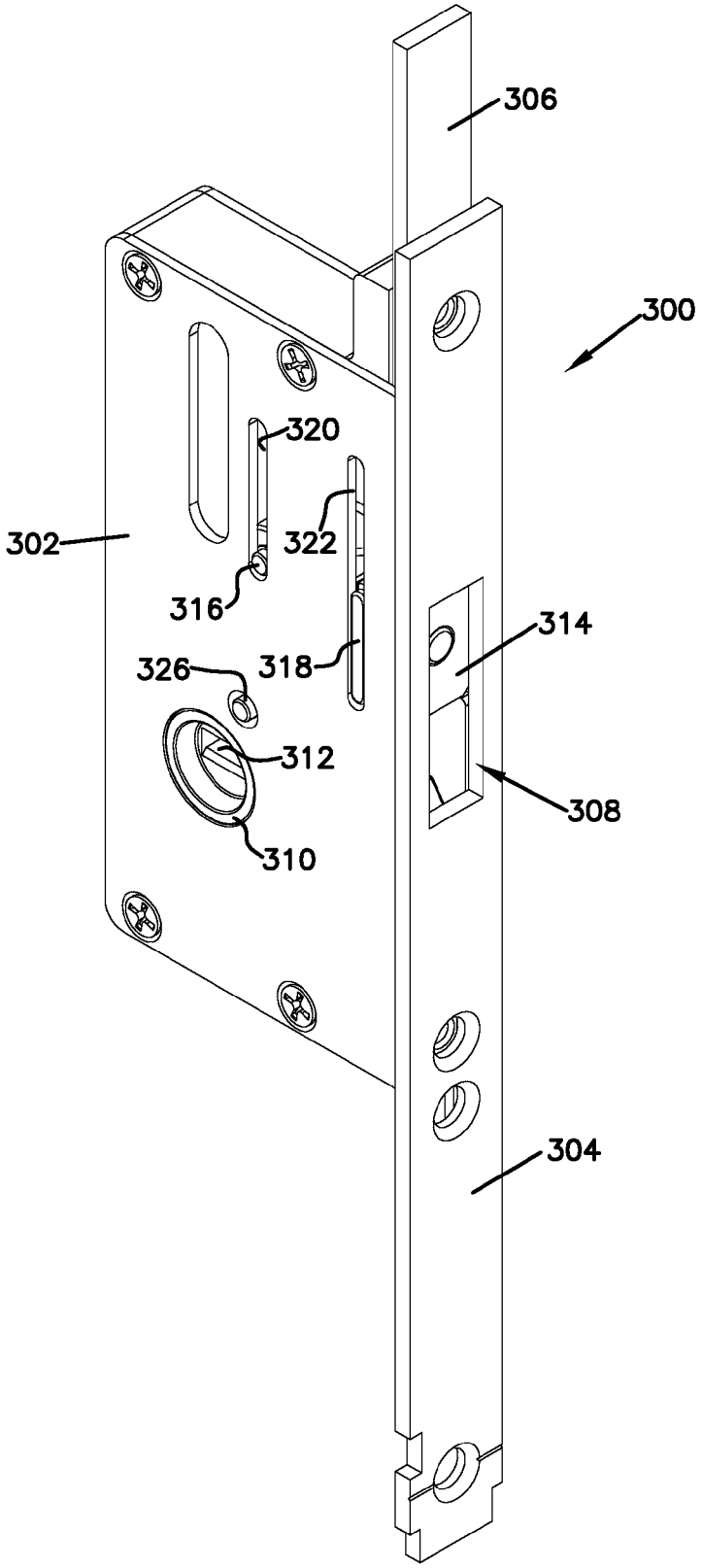
FIGS. 3A-3B depict perspective views of a passive lock mechanism of a passive lock assembly in an unlocked and a locked position, respectively.
Figure 3B:
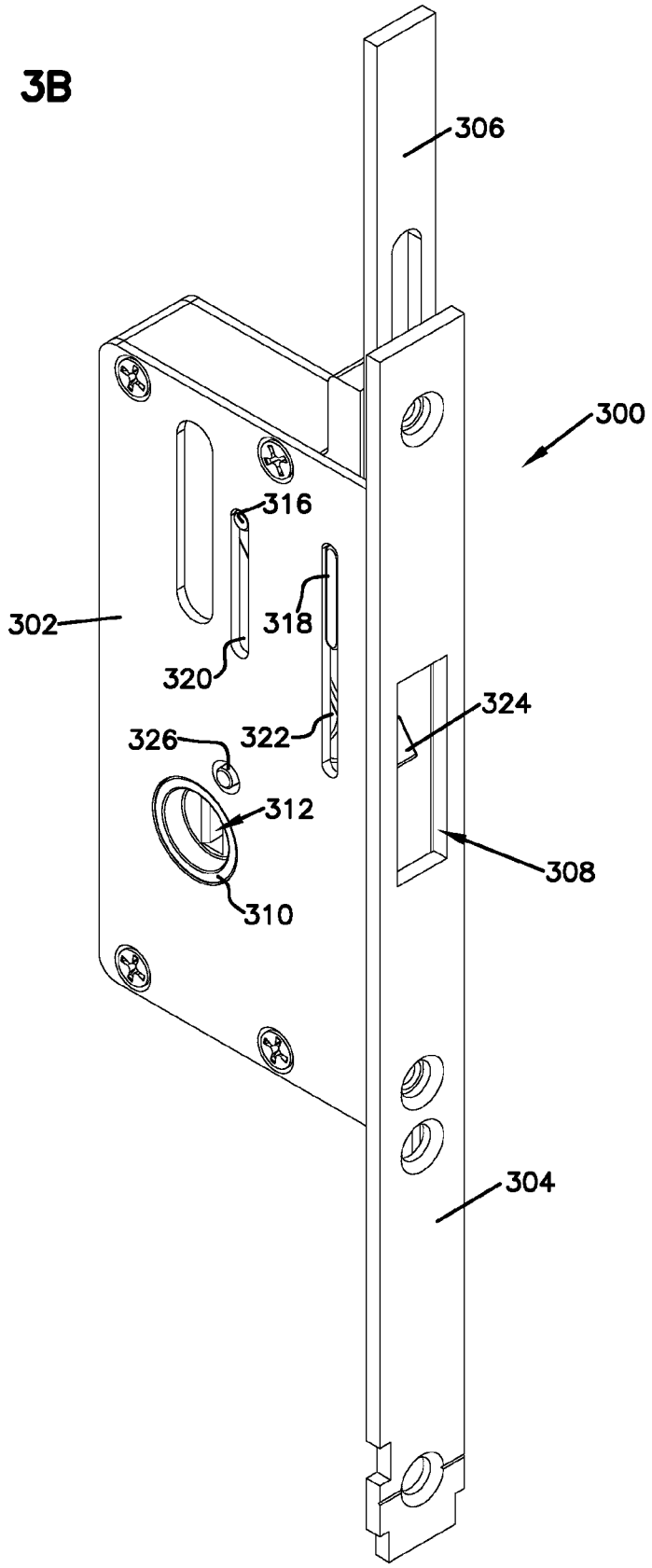

FIGS. 3A and 3B depict exterior perspective views of the passive lock mechanism 300 of a passive door lock assembly. The passive lock mechanism 300 includes a housing 302 that is connected to a face plate 304 that shields a drive bar 306. The face plate 304 defines an opening 308 configured to receive a deadbolt extending from an active door lock assembly, such as one of the types (that is, having a single housing or two discrete housings) depicted and described above. The housing 302 may include a similar opening on the locking face of the housing 302 or the locking face may be completely open. The locking face, in this case, is the face of the housing 302 that faces the opposing, active door. The lock housing 302 pivotably receives an actuator 310 that defines a slot 312. The slot 312 is configured to receive a tailpiece from a thumbturn or a key cylinder. Typically, the thumbturn is located on an interior side of the door, while the key cylinder is located on an exterior side of the door. FIG. 3A depicts the passive lock mechanism 300 in the unlocked position, while FIG. 3B depicts the passive lock mechanism 300 in the locked position.

Relevant to the each of the two depicted positions are the positions of the drive bar 306 and certain elements located within the housing 302. The drive bar connection element 306, in this case, acts as a blocking element, thus denying a deadbolt passage into the housing 302 when positioned as depicted in FIG. 3A. As depicted in FIG. 3A, when in the unlocked position, a drive bar connection element 314 extends into a path of travel of the deadbolt. In the depicted embodiment, this leaves the opening 308 partially blocked by a portion of the drive bar 306 and the drive bar connection element 314. This opening blocked position prevents passage of the deadbolt into the opening 308, thus preventing improper locking of the double door assembly, as described in more detail below. FIG. 3B depicts the passive lock mechanism 300 in the locked position, where the drive bar connection 314 has moved vertically upward within the housing 302 (as evidenced by location of a pendulum pin 316 and a slide pin 318 at the upper positions of their respective slots 320, 322). With the drive bar connection 314 in an unblocking position (i.e., out of the deadbolt path of travel or clear of the opening 308), the deadbolt is free to pass into the opening 308 and, if the deadbolt and astragal are dimensioned appropriately, contact an internal pendulum 324 located in the housing 302. A pin 326 projects into the housing 302 and is described further below. Also, in FIG. 3B, the actuator 310 has been rotated from its initial position depicted in FIG. 3A.

Figure 3C:
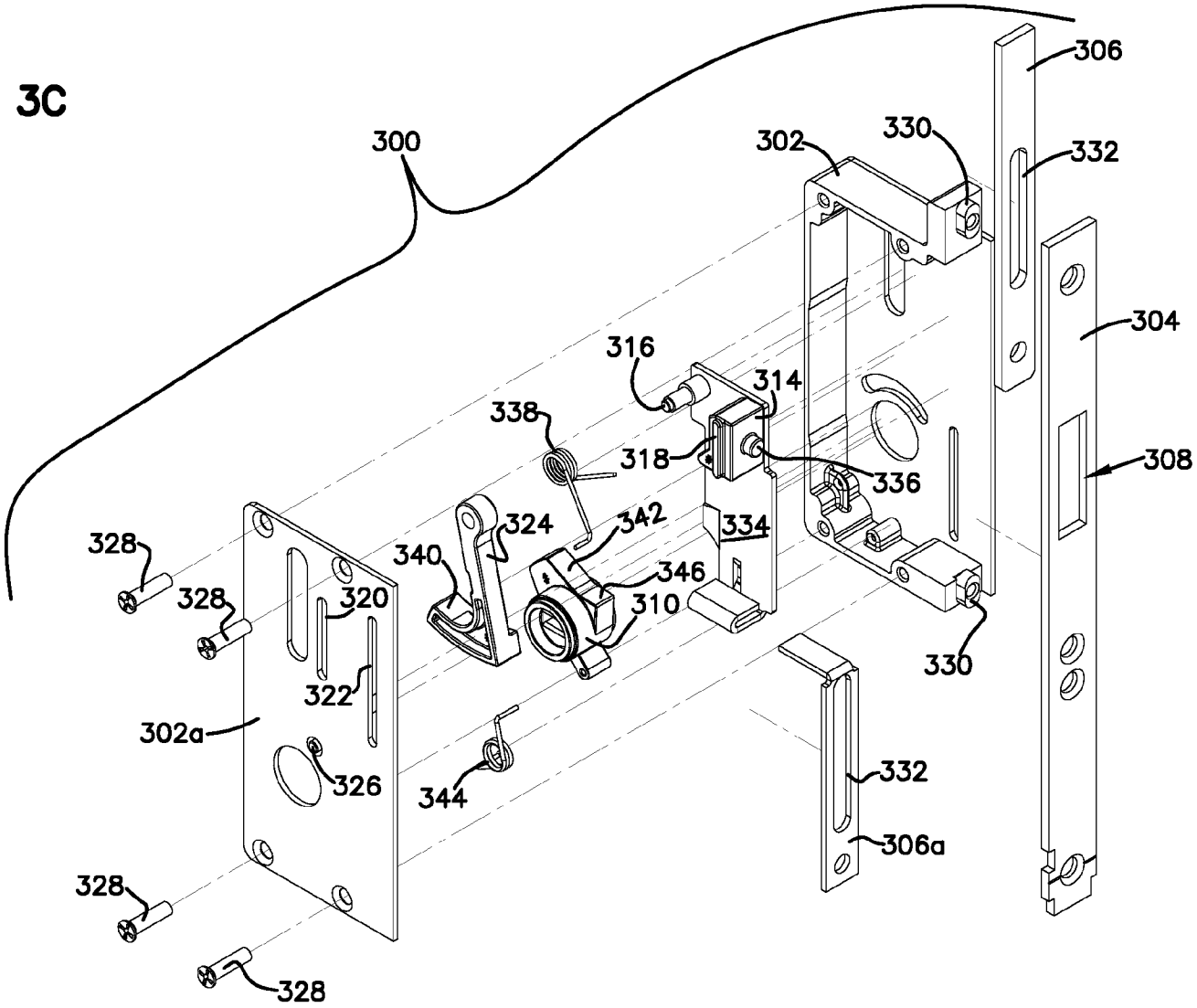
FIG. 3C depicts an exploded view of a passive lock mechanism.

FIG. 3C depicts an exploded view of the passive lock mechanism 300, including additional components not visible in FIGS. 3A and 3B. The housing 302 includes a housing cover plate 302*a* that defines the various slots 320, 322 located therein. The cover plate 302*a* may be secured to the housing 302 with a number of screws 328, pins, or other mechanical and/or adhesive elements. As apparent from these figures, the face plate 304 covers the open front locking face of the housing 302. The housing 302 also includes a number of guides 330 that guide the drive bars 306, 306*a* during vertical movement, by engaging with slots 332 located thereon. The lower drive bar 306*a* engages with a slide 334 configured to move vertically within the housing 302. The end of the drive bar 306*a* opposite the slide 334 passes into the drive bar mechanism housing (as depicted in FIG. 2, 202), and is moved vertically by rotation of the associated handle (FIG. 2, 208). The slide 334 is also connected to the upper drive bar 306 at the drive bar connection 314 that includes, in the depicted embodiment, a pin 336. Additionally, the slide 334 supports the pendulum pin 316 such that the pendulum 324 moves vertically with the slide 334. Additionally, since the pendulum 324 is pivotably mounted to the pendulum pin 316, it may be biased with a pendulum spring 338, as described in more detail below. The pendulum 324 also includes a projection 340, also described below. Finally, the actuator 310 includes a dog 342 projecting therefrom, and may also be biased by a bi-stable spring 344. The actuator 310 also includes a slide engagement element 346, the operation of which is described below.

Figure 4A:
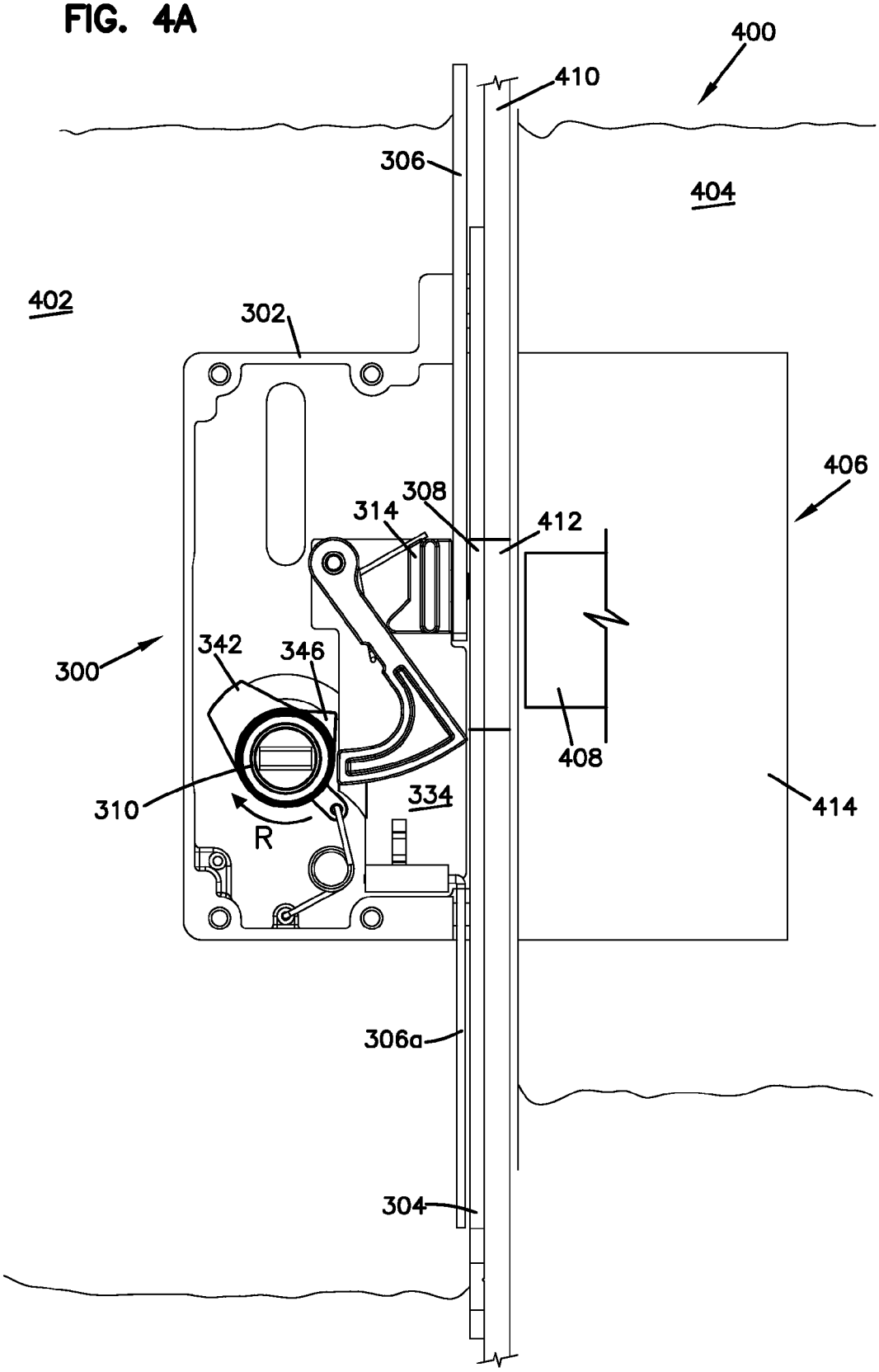
FIGS. 4A and 4B are enlarged side sectional views of a double door assembly having a thin astragal and an active deadbolt mechanism and a passive lock mechanism.

FIG. 4A depicts the passive lock mechanism 300 of FIG. 3C installed in a passive door 402 of a double door assembly 400. The face plate 302*a* of the lock mechanism 300 is not depicted. An active door 404 is also depicted and includes a deadbolt mechanism 406 having a locking element such as a deadbolt 408. Elements not depicted include a drive bar mechanism (as depicted in FIG. 2, 202), which would be connected to an end of the drive bar 306*a*. Since the structure and operation of the deadbolt mechanism 406 and the drive bar mechanism is not critical to the operation of the passive lock mechanism 300, these elements and components thereof are not described further. Also not described is an active door latch mechanism that is installed in conjunction with the deadbolt mechanism 406 to form the active door lock assembly. As noted above, active door lock assemblies utilizing discrete deadbolt mechanisms and latch mechanisms are described in U.S. patent application Ser. No. 13/189,305. The passive lock assembly described herein may also be utilized in conjunction with active door lock assemblies contained within a single housing. The passive door lock mechanism 300 described herein may be used in doors that include shallow astragals, deep astragals, or that do not include astragals. An astragal is a molding profile that is used to fill the clearance gap between two opposing doors of a double door assembly and is typically installed on the passive door. Here, the passive door 402 includes an astragal 410 that is secured to a locking face of the passive door 402. In this case, the astragal 410 is somewhat thin and is installed on the passive door 402 directly over the faceplate 304 of the lock mechanism 300. An astragal opening 412 is aligned with the faceplate opening 308, if the housing 302 includes such an opening. When the locking face of the passive lock mechanism 300 does not define an opening, the passive lock mechanism 300 should be positioned such that at least one of the upper drive bar 306, the drive bar connection 314, and the pin 336 extend into a path of travel of the deadbolt 408, when one of these elements is in the lower position.

FIG. 4A depicts a door assembly 400 in the unlocked position. In the unlocked position, the deadbolt 408 is retracted within a housing 414 of the deadbolt mechanism 406. Also in the unlocked position, the slide 334 is located in a lower position within the housing 302 of the passive lock mechanism 300. When in this lower position, the upper drive bar 306, the drive bar connection 314, and the pin 336 extend into a path of travel of the deadbolt 408, and are, thus, in a blocking position, relative to the openings 308, 412. In other embodiments, only the upper drive bar 306 may extend into the path of travel, depending on the length of the drive bar 306 and the configuration of the drive bar connection 314. In other embodiments, an element separate from the drive bar 306 and the drive bar connection 314 may be in the opening blocked position. When in the blocked position, the deadbolt 408 is denied passage into an interior of the housing 302, since contact between the deadbolt 408 and the drive bar connection 314 when the latter element is in the blocked position prevents complete extension of the deadbolt 408. In cases where a thinner astragal (as depicted) or no astragal is used, this blocking contact will prevent complete rotation of the associated thumbturn that drives the deadbolt 408, thus signaling the user that the door assembly 400 is not fully secured. Additionally, when the slide 334 is in the lower position, rotation R of the actuator 310 is prevented because the slide engagement element 346 contacts the slide 334. Accordingly, a user will become aware that the passive door 402 is not secured when rotation of the actuator 310 via the thumbturn is not possible.

Figure 4B:
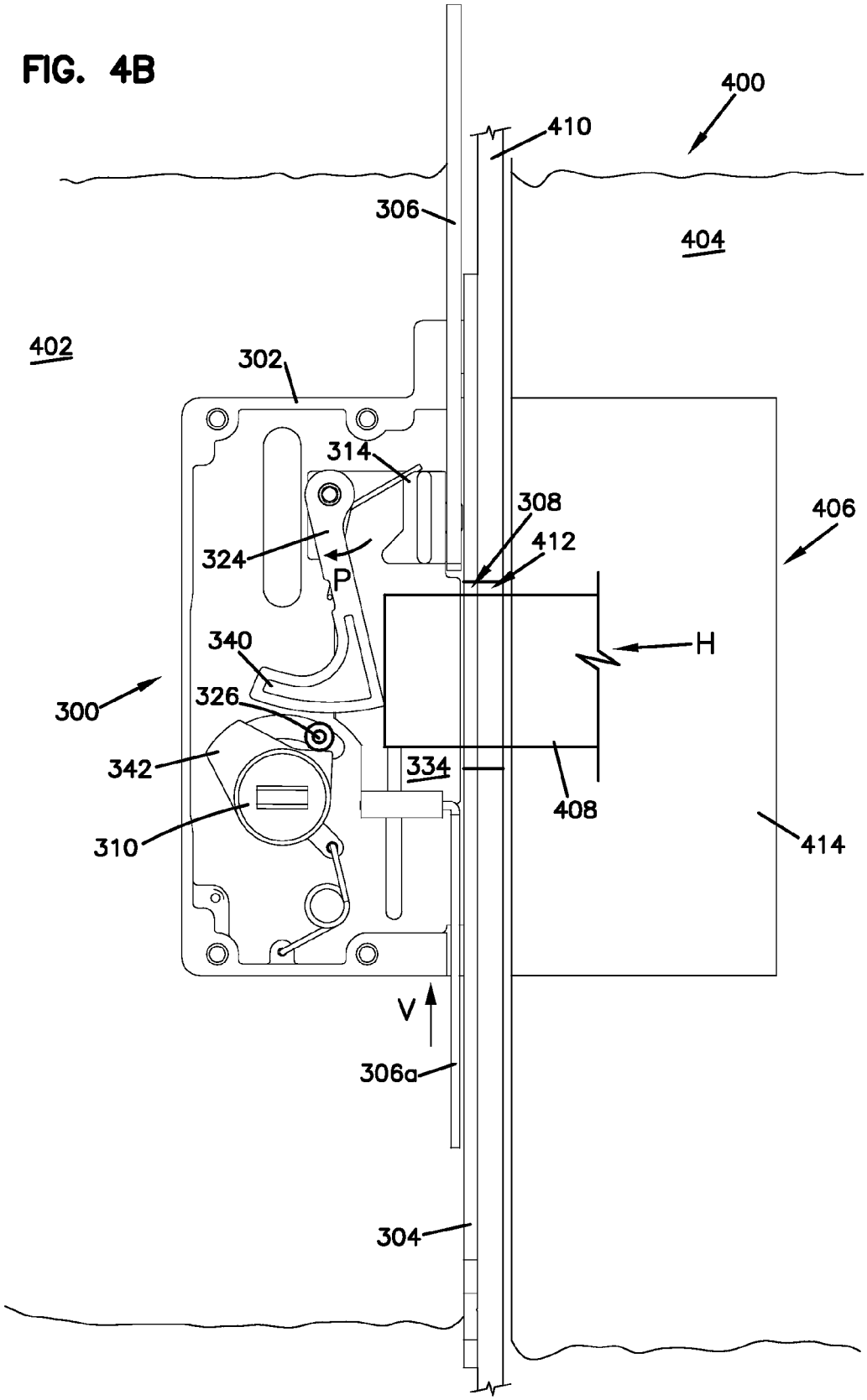

FIG. 4B depicts the door assembly 400 in the locked position. To move the passive lock mechanism 300 of the door assembly 400 to the locked position, the lower drive bar 306*a* must first be moved vertically V. This occurs as a result of rotating the handle (FIG. 2, 208) of the drive bar mechanism upward. Upward vertical movement V of the drive bar 306*a* moves the slide 334 upward, to an upper position within the housing 302, as depicted in FIG. 4B. This, in turn, drives the upper drive bar 306 upward. As described above, the upper drive bar 306 may directly engage a door header, or may actuate a supplemental lock device or system. In other embodiments, rotation of the handle (FIG. 2, 208) of the drive bar actuation mechanism may also actuate a drive bar to lock a lower portion of the passive door 402. Regardless, when the slide 334 is in the upper position and the drive bar connection element 314 in the opening unblocked position (not in the path of travel of the deadbolt 408), the passive door 402 is in a locked position. In this locked position, the passive door 402 is secured to an associated door frame so as to form a solid structure against which to lock the active door 404.

With the drive bar connection element 314 no longer in the path of travel of the deadbolt 408, the deadbolt 408 may now be advanced horizontally H into the interior of the housing 302, as depicted in FIG. 4B. As the deadbolt advances horizontally H, it contacts the pendulum 324 and pivots P the pendulum 324 in a direction away from the lock face. The actuator 310 may be rotated by the user to place the dog 342 into the downward path of travel of the slide 334, although this is not required. This prevents a user from attempting to unsecure the passive door 402 by simply rotating the drive bar actuation handle. It should be noted that certain embodiments of the lock mechanism 300 need not include the actuator 310, however. With the deadbolt 408 extended and located in the path of travel of the drive bar connection element 314, the passive door 402 cannot be unlocked. Embodiments that include the actuator 310 may be desirable, however, from an aesthetic standpoint, or to be consistent with user expectations. To unsecure the door assembly 400, then, the deadbolt 408 must first be retracted and the actuator 310 rotated (if present). Otherwise, should a user attempt to rotate downward the handle (FIG. 2, 208) of the drive bar mechanism, the internal components of the passive lock mechanism 300 prevent the passive door from being unlocked (i.e., the drive bars 306 from being retracted). If an attempt is made to rotate the handle (FIG. 2, 208), the projection 340 of the pendulum will also contact the pin 326 that projects from an interior of the housing 302 (usually the inside of the faceplate 302*a*), further preventing movement of the slide 334 and connected components. Thus, the pin 326 acts as a blocking element to prevent movement of the slide 334 when the slide 334 is positioned as depicted in FIG. 4B. This is in addition to potential contact between the drive bar connection element 314 and the deadbolt 408 and the slide engagement element 346 and slide 334 (if the actuator 310 is present and has been rotated). Depending on the location and/or size of the deadbolt 408, the drive bar connection element 314 may not necessarily contact the deadbolt 408, and the drive bar 306 may move sufficiently far so as to allow the passive lock mechanism 300 to be defeated. Accordingly, the contact between the pendulum 324 and the pin 326 prevents improper disengagement of the door lock assembly.

Figure 5A:
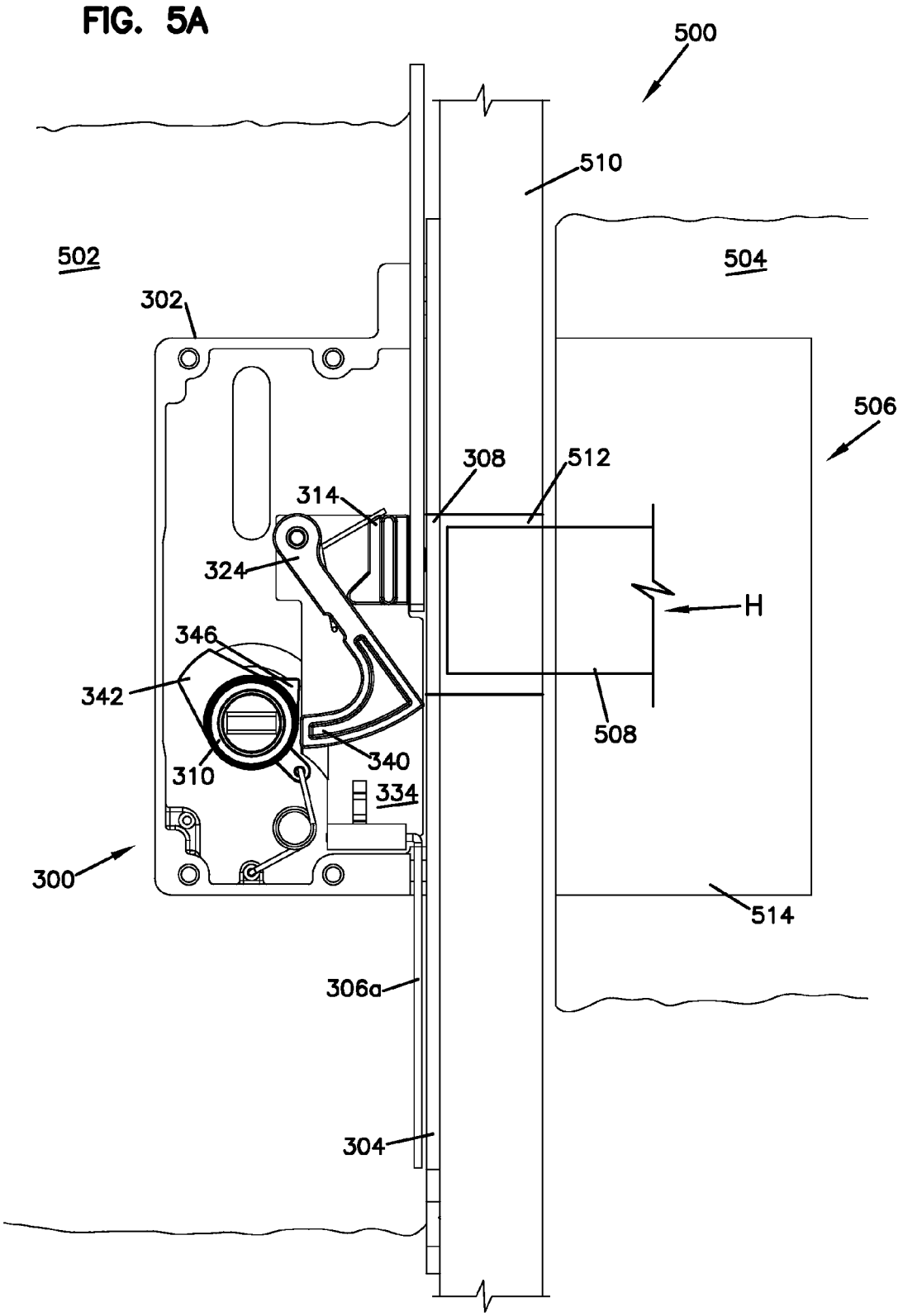
FIGS. 5A and 5B are enlarged side sectional views of a double door assembly having a thick astragal and an active deadbolt mechanism and a passive lock mechanism.
Figure 5B:
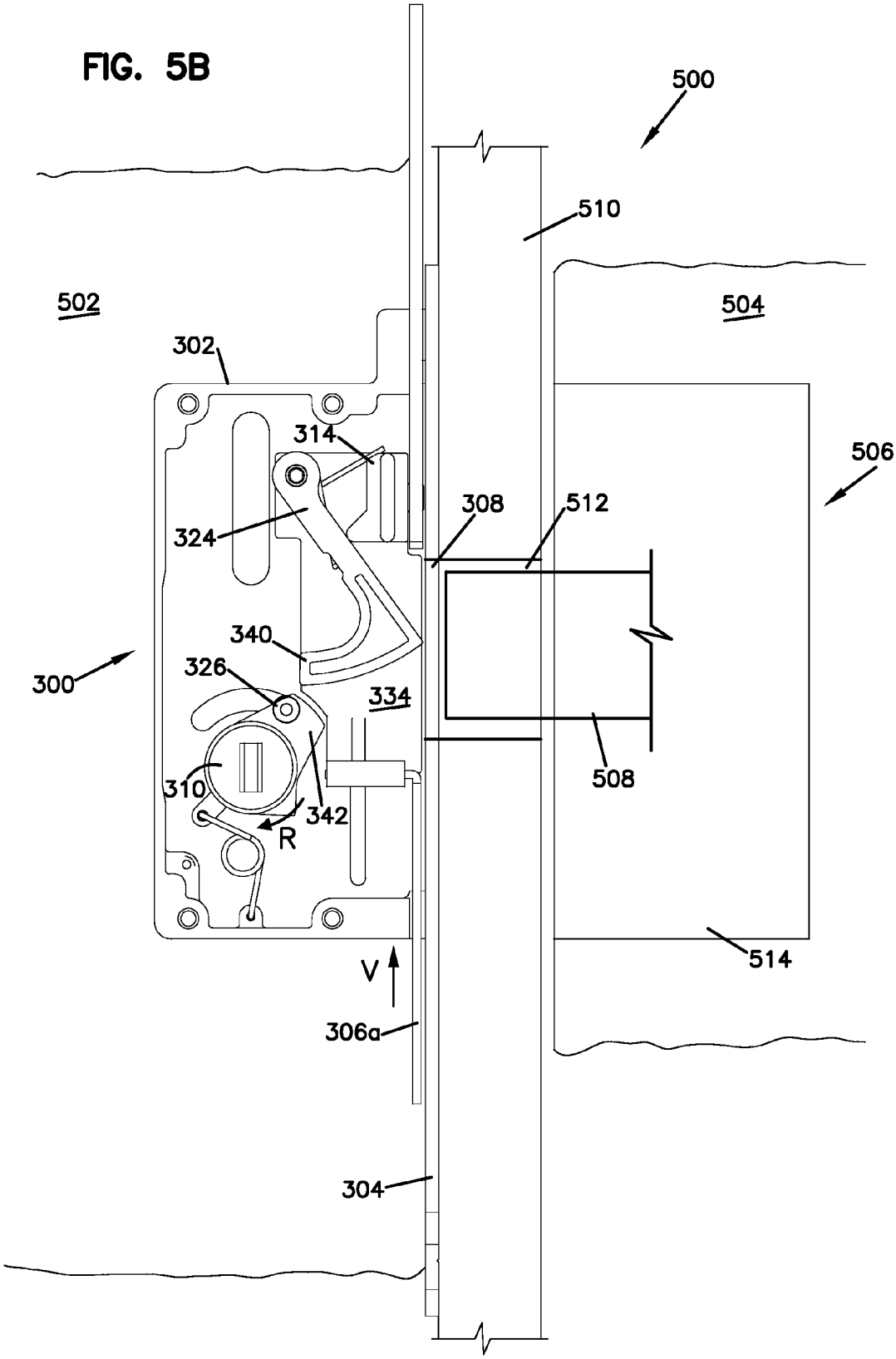

An additional benefit of the passive lock mechanism 300 is apparent from FIGS. 5A and 5B, which depicts a double door assembly 500 where a deep astragal 510 is connected to the passive door 502. In this case, the deep astragal 510 is of a depth such that the deadbolt 508 cannot reach an interior of the housing 302 when full extended horizontally H. In that case, even though the deadbolt 508 is fully extended, it does not contact the drive bar connection element 314, even though the element 314 is in the lower opening blocking position and in the path of travel of the deadbolt 508. While the deadbolt 508 is secured in the astragal opening 512, the door assembly 500 itself is not secured, because the passive door lock mechanism 300 is not locked. Accordingly, the security of the door assembly 500 is easily compromised. In such a configuration, the passive lock mechanism 300 of the passive door 502 may be unlocked because the deadbolt 508 is unable to block a downward path of travel of the drive bar connection element 314. Additionally, since the deadbolt 508 has not pivoted the pendulum 324 away from the lock face, contact between the projection 340 and the pin 326 also cannot prevent the unlocking of the lock mechanism 300. Accordingly, it may be difficult for a user to recognize that the passive door lock mechanism 300 is not activated and, accordingly, that the door assembly 500 is not secured.

FIG. 5B depicts the door assembly 500 in a locked and secured position. As discussed above, due to the depth of the deep astragal 510, it may be unclear to a user that the door assembly 500 is not sufficiently secured. The present technology, however, intuitively guides a user in proper operation of the door lock assembly by utilizing a thumbturn connected to the actuator 310. Once the handle (FIG. 2, 208) of the drive bar actuation mechanism is rotated upwards, so as to move the drive bar 306*a* and connected components vertically upwards V, the user may then rotate R the actuator, so as to place the dog 342 in blocking position relative to the slide 334, as depicted in FIG. 5B. The dog 342 need not contact the slide 334, but need only project into a downward path of travel thereof. The spring 344 biases the actuator 310 into this blocking position. Thus, the dog 342 acts as a blocking element to prevent movement of the slide 334 when the slide 334 is positioned as depicted in FIG. 5B. Because both the active 506 and passive door lock mechanisms 300 utilize a thumbturn, this makes the use thereof to secure the door very intuitive for most users. It is well-recognized even among non-technical users that actuation of a thumbturn on a lock is often required to secure a door lock. Accordingly, by having a thumbturn on the passive lock, this helps ensure proper use of the passive door lock 300.

In other embodiments, a deep astragal may include a deadbolt extension, which may be utilized to penetrate the passive lock housing even when the deadbolt 508 is too short to do so. In such an embodiment, the deadbolt extension element may telescope or project from the astragal into the housing 302 due to a force applied by the deadbolt 508 into a rear portion of the deadbolt extension element.

The materials utilized in the manufacture of the passive lock mechanism may be those typically utilized for lock manufacture, e.g., zinc, steel, brass, stainless steel, etc. Material selection for most of the components may be based on the proposed use of the passive lock mechanism, level of security desired, etc. Appropriate materials may be selected for a passive lock mechanism used on patio or entry doors, or on doors that have particular security requirements, as well as on passive lock mechanisms subject to certain environmental conditions (e.g., moisture, corrosive atmospheres, etc.). For particularly light-weight door panels (for example, cabinet door panels, lockers, or other types of panels), molded plastic, such as PVC, polyethylene, etc., may be utilized for the various components. Nylon, acetal, Teflon®, or combinations thereof may be utilized as required or desired to reduce friction, although other low-friction materials are contemplated.

Positional terms such as upper, lower, etc., as used herein, are relative terms used for convenience of the reader and to differentiate various elements of the passive lock mechanism from each other. In general, unless otherwise noted, the terms are not meant to define or otherwise restrict location of any particular element. For example, the passive lock mechanism may be installed below a drive bolt actuation mechanism on a door.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A lock mechanism for an inactive door, the lock mechanism comprising:

a housing configured to receive a locking element from an active door lock;

a slide movably received in the housing and comprising a drive bar connection element, wherein when the slide is in an unlocked position, the drive bar connection element is located in a path of travel of the locking element, and wherein when the slide is in a locked position, the drive bar connection element is located outside the path of travel of the locking element;

at least one drive bar at least partially received in the housing, wherein the drive bar is connected to the drive bar connection element and wherein the drive bar is actuated by an actuator located remote from the housing; and a blocking element located within the housing, wherein the blocking element prevents movement of the slide from the locked position to the unlocked position, wherein the blocking element is pivotably connected to the housing and comprises a dog, wherein when the blocking element is in a slide blocked position, the dog is located within a path of travel of the slide, and wherein when the blocking element is in a slide unblocked position, the dog is located outside a path of travel of the slide.

2. The lock mechanism of claim 1, wherein the blocking element comprises an actuator adapted to be actuated by at least one of a thumbturn located external to the housing and a key cylinder located external to the housing.

3. The lock mechanism of claim 1, wherein the blocking element is biased into both of the slide blocked position and the slide unblocked position.

4. The lock mechanism of claim 3, wherein the blocking element is adapted to be rotated from the slide unblocked position to the slide blocked position only when the slide is in the locked position.

5. The lock mechanism of claim 1, wherein the blocking element is pivotably connected to the slide so as to travel vertically with the slide, and wherein the blocking element comprises a projection, wherein when the blocking element is in the slide blocked position, the projection is positioned such that a pin extends into a path of vertical travel of the projection.

6. The lock mechanism of claim 5, wherein the blocking element is biased into the slide unblocked position, wherein the pin does not extend into a path of vertical travel of the projection.

7. The lock mechanism of claim 5, wherein the blocking element is adapted for movement from the slide unblocked position to the slide blocked position due to contact with the locking element extending into the housing.

8. The lock mechanism of claim 1, wherein the blocking element comprises an actuator pivotably connected to the housing.

9. The lock mechanism of claim 1, wherein the slide is adapted to move vertically due to actuation of an element located discrete from the housing.

10. The lock mechanism of claim 1, further comprising a drive bar actuation mechanism for moving the slide between the unlocked position and the locked position.

11. The lock mechanism of claim 10, wherein the drive bar actuation mechanism is located in a drive bar actuation mechanism housing discrete from the housing.

12. The lock mechanism of claim 11, wherein the drive bar actuation mechanism is operated by pivotal movement of a handle located on the drive bar actuation mechanism housing.

13. A lock mechanism for an inactive door, the lock mechanism comprising:

a slide for selectively moving a drive bar between a locked position and an unlocked position;

a first blocking element for preventing movement of the slide from the locked position to the unlocked position, wherein the first blocking element prevents movement of the slide when contacted by a deadbolt inserted into the lock mechanism, wherein the first blocking element is pivotably connected to the slide and is configured to move linearly with the slide; and a second blocking element for selectively preventing movement of the slide from the locked position to the unlocked position, wherein the second blocking element comprises a dog, and wherein the dog is located within a path of travel of the slide when the second blocking element is in a slide blocked position and the dog is located outside a path of travel of the slide when the second blocking element is in a slide unblocked position.

14. The lock mechanism of claim 13, wherein the first blocking element prevents movement of the slide due to contact between the first blocking element and a projection extending from a housing of the lock mechanism.

* * * * *